US006887191B2

(12) United States Patent
Bressler et al.

(10) Patent No.: US 6,887,191 B2
(45) Date of Patent: May 3, 2005

(54) CARTON BOTTOM FORMING METHOD AND APPARATUS

(75) Inventors: Allen Bressler, Cedar Rapids, IA (US); Lyle Knutson, Cedar Rapids, IA (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/657,662

(22) Filed: Sep. 8, 2003

(65) Prior Publication Data

US 2005/0054503 A1 Mar. 10, 2005

Related U.S. Application Data

(62) Division of application No. 09/689,193, filed on Sep. 12, 2000, now Pat. No. 6,626,810.

(51) Int. Cl.[7] ..... B31B 1/28

(52) U.S. Cl. ..... 493/176; 493/165; 493/175; 493/184; 53/376.4; 53/565

(58) Field of Search ..... 493/163, 164, 493/165, 167, 175, 176, 180, 183, 184; 53/458, 53/491, 377.6, 563, 376.4, 564

(56) References Cited

U.S. PATENT DOCUMENTS

| | | | |
|---|---|---|---|
| 3,943,834 | A | 3/1976 | Vetten |
| 3,999,469 | A | 12/1976 | Nilsson |
| 4,738,077 | A | 4/1988 | Wakbayashi et al. |
| 4,788,811 | A | 12/1988 | Kawajiri et al. |
| 4,805,380 | A | 2/1989 | Mosse |
| 4,990,128 | A | 2/1991 | Murrah |
| 5,102,485 | A | 4/1992 | Keeler et al. |
| 5,120,292 | A | 6/1992 | Ueda et al. |
| 5,167,607 | A | 12/1992 | Larsen |
| 5,234,398 | A | 8/1993 | Larsen |
| 5,304,265 | A | 4/1994 | Keeler |
| 5,324,250 | A | 6/1994 | Janson et al. |
| 5,369,933 | A | 12/1994 | Waldstadt |
| 5,482,204 | A | 1/1996 | Mills et al. |

(Continued)

FOREIGN PATENT DOCUMENTS

EP 0575008 B1 9/1996

(Continued)

*Primary Examiner*—Louis Huynh
(74) *Attorney, Agent, or Firm*—Melvin D. Fletcher

(57) ABSTRACT

An apparatus for forming the bottom end wall of a carton from a rectangular carton blank having oppositely disposed scored end panels and oppositely disposed unscored end panels includes a rotating mandrel assembly adapted to receive an open-ended carton blank through an open top end of the carton blank, a heating station, a folding station and a sealing station. The folding station has a pair of oppositely disposed reciprocating break fingers to contact and fold inwardly the scored bottom end panels and biasing means for folding inwardly down the unscored bottom end panels. The folding station is rotatable 90° between two functional orientations, a first orientation wherein the break fingers are aligned in the direction of mandrel movement, and a second orientation in which the break fingers are perpendicular to the direction of mandrel movement.

12 Claims, 3 Drawing Sheets

U.S. PATENT DOCUMENTS

| | | | | |
|---|---|---|---|---|
| 5,538,491 | A | 7/1996 | Owen et al. | |
| 5,588,943 | A | 12/1996 | Mills et al. | |
| 5,636,785 | A | 6/1997 | Kalberer et al. | |
| 5,681,253 | A | 10/1997 | Owen et al. | |
| 5,683,339 | A | 11/1997 | Mills et al. | |
| 5,810,243 | A | 9/1998 | DiPinto et al. | |
| 6,162,156 | A | 12/2000 | Fujikawa et al. | |
| 6,339,914 | B1 | 1/2002 | Fujikawa et al. | |
| 6,343,460 | B1 | 2/2002 | Fujikawa et al. | |
| 6,626,810 | B1 * | 9/2003 | Bressler et al. | 493/176 |

FOREIGN PATENT DOCUMENTS

| | | | |
|---|---|---|---|
| EP | 0900728 | A1 | 3/1999 |
| EP | 0938965 | A2 | 3/1999 |
| EP | 0968922 | A1 | 1/2000 |
| EP | 0698555 | B1 | 3/2000 |
| EP | 0999135 | A1 | 5/2000 |
| EP | 0999136 | A1 | 5/2000 |
| EP | 1043232 | A1 | 10/2000 |
| JP | 2000-127260 | | 9/2000 |

* cited by examiner

CARTON BOTTOM FORMING METHOD AND APPARATUS

This application is a divisional of application Ser. No. 09/689,193, filed Sep. 12, 2000 now U.S. Pat. No. 6,626, 810.

FIELD OF THE INVENTION

This invention pertains generally to an apparatus and method for forming cartons from precut paperboard carton blanks, and more particularly to a method and apparatus for folding the bottom panels of a carton blank to form the bottom end wall of a carton.

BACKGROUND OF THE INVENTION

Conventional paperboard cartons for liquid food products are commonly constructed from paperboard sheets coated with a film of a heat sealable, waterproof thermoplastic material such as polyethylene, polyvinyl chloride or polypropylene. When heated, this plastic film becomes tacky, so that sheets thus coated and heated can be sealed together by being squeezed tightly together. The coated sheets are initially cut into flat carton blanks. These blanks are subsequently folded into a generally rectangular open-ended configuration, then are closed at one end by forming a bottom end wall via folding and sealing bottom end closure panels which extend integrally from the four side walls of the carton blank. The cartons can then be filled and sealed with a gabled or flat-folded top.

In a type of apparatus commonly employed for assembling paperboard cartons, the partially assembled, rectangular, open-ended cartons are individually loaded, top end first, onto a rotatable assembly having a number of mandrels directed radially outward so that the bottom end closure panels extend beyond the end of the mandrels and describe a circular path as the mandrel rotates about a central axis. Along this circular path are a series of regularly spaced carton processing stations; as each rotating mandrel brings its respective carton bottom end into alignment with a processing station, the rotation stops momentarily so that the carton at each station can be processed appropriately. This indexing sequence allows for rapid processing of many cartons.

In addition to the infeeding station for loading the carton blanks onto the mandrel, other processing stations generally include heating, folding, sealing, cooling and outfeeding. The heating step can be performed before or after the folding step, as long as the plastic film coating remains sufficiently hot and tacky to form a strong bond at the sealing station. The present invention concerns the sequence of operation wherein the bottom end closure panels are heated prior to folding, as this is simpler in operation and minimizes movement of the carton after folding, thus resulting in improved bottom alignment, i.e., bottom square is improved.

Accordingly, each rectangular carton blank is loaded onto a mandrel, indexed to the heating station where the bottom end closure panels are heated, then is indexed again to a bottom panel folding station.

At the bottom folding station, as shown in FIG. 1, representative of known designs, the bottom end panels are folded inward and down to form the bottom end wall. The standard carton design as shown comprises a rectangular carton blank having open top and bottom ends, first, second, third and fourth body panels adjoining first, second, third and fourth bottom end closure panels, respectively, with the first and third bottom end panels oppositely disposed and scored to fold inwardly when the second and fourth bottom end closure panels are folded inwardly down to form the bottom of the carton. In practice, the carton blank is loaded onto the mandrel with either the second or fourth (unscored) bottom end panel facing in the direction of movement of the mandrel. At the folding station, a pair of break fingers contact and push inward on the first and third bottom end panels from the sides, which starts the actual folding of the bottom panels. This folding, or "breaking" of the scored bottom end panels acts to partially pull down the second and fourth bottom end panels, which are then biased further downward by a hooder assembly having a pair of inwardly angled surfaces. The hooder assembly moves up and down in line with the longitudinal axis of the carton, and the angled surfaces act to urge the second and fourth bottom end panels downward to substantially complete folding of the bottom end wall.

This design, however, requires that the carton blank be loaded onto the mandrel with the two scored bottom end panels on the sides of the mandrel, relative to movement, so that the break fingers do not interfere with the carton rotation between stations. This can problematic for certain carton designs for which it is preferred that the carton assume a position 90° offset from standard. Such carton designs thus require an extra turning step when utilizing known machinery.

After the bottom panels have been folded, further indexing of the mandrel advances the carton blank to the sealing station where the heated, folded bottom panels are sealed together to form the bottom end wall of the carton. In order to seal the folded end panels together, they are fused together by a bottom sealing plate which applies pressure to the folded end panels by pressing them between the sealing plate and the end of the mandrel upon which the carton blank resides.

Further indexing of the mandrel from the sealing station moves the carton blank to an optional cooling station, followed by a final indexing to an outfeed station, where the closed-end carton is set down on the now sealed flat bottom for filling and top sealing.

SUMMARY OF THE INVENTION

The present invention is directed to a method and apparatus wherein the scored bottom end closure panels are oriented front and back relative to the direction of mandrel movement, with the unscored bottom end closure panels on the sides. With this orientation, the completed cartons can exit the outfeed station in proper position for subsequent processing, eliminating the need for an additional carton turning step. Additionally, the inventive folding apparatus can be employed to readily retrofit older machinery without major mechanical alterations. The apparatus of the present invention also has improved versatility over the known devices, as the folding station can simply be turned 90° to accommodate carton designs for which it is preferred that the scored bottom end closure panels are on the sides, rather than front and back, relative to movement of the mandrels.

BRIEF DESCRIPTION OF THE DRAWING FIGURES

DETAILED DESCRIPTION OF THE INVENTION

Figure 1:
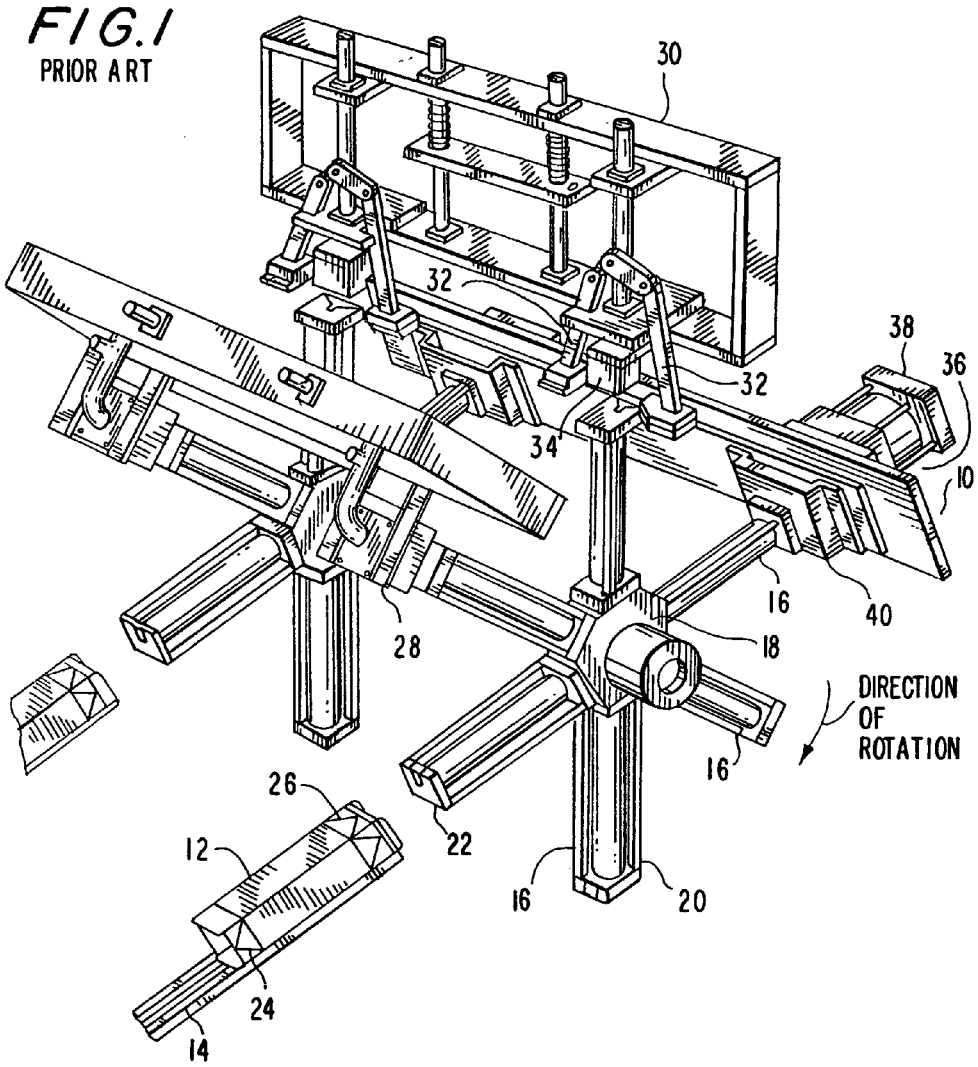
FIG.1 PRIOR ART
FIG. 1 is a perspective view of a known apparatus for forming a bottom end wall of a rectangular carton.
Figure 2:
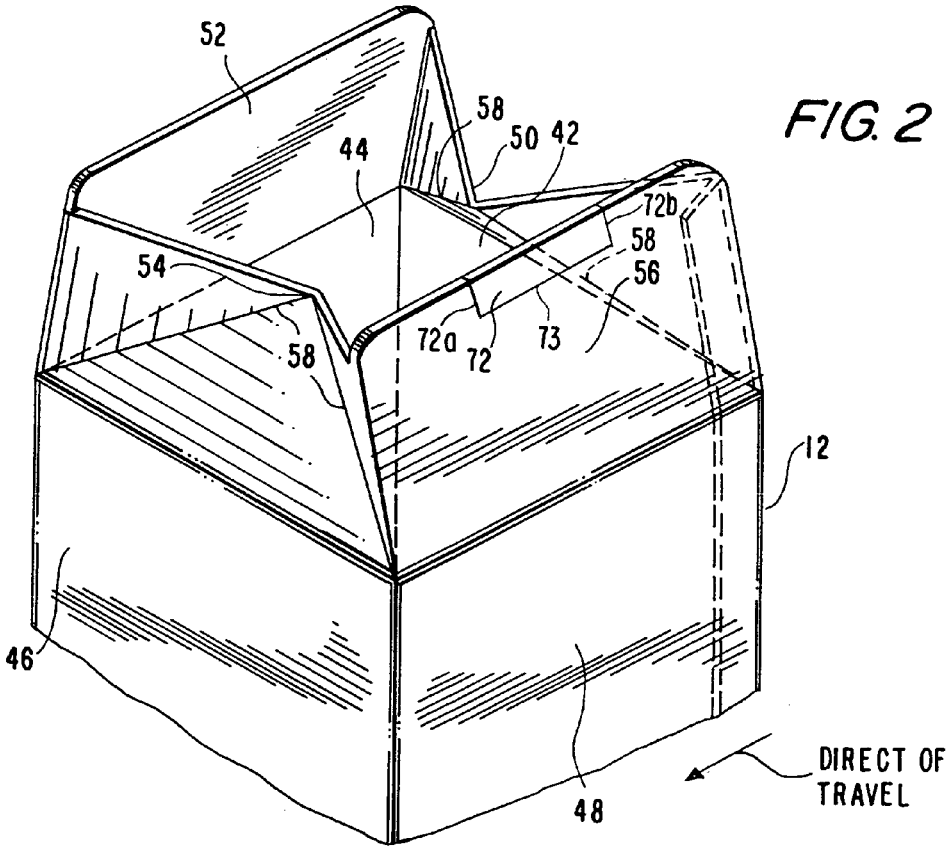
FIG. 2 is a perspective view of a partially folded open bottom end of a rectangular carton blank.

Referring initially to FIG. 1, the present invention can be best understood by considering a known apparatus for forming the bottom end wall of a rectangular carton 12. Rectangular is intended herein to include cartons having a square cross-section. The rectangular carton blanks 12 are illustrated in FIG. 2, and have open bottom 24 and top 26 ends, with first 42, second 44, third 46 and fourth 48 body panels adjoining first 50, second 52, third 54 and fourth 56 bottom end closure panels, respectively. The bottom end closure panels are integral with the body panels to which they are adjoined, with a score line at the juncture between body panels and end panels so that the end panels can readily fold inward to form the bottom end wall of the carton. The first 50 and third 54 bottom end closure panels are oppositely disposed and are scored to fold inwardly when the second 52 and fourth 56 bottom end closure panels are folded inwardly down to form the bottom of the carton. As shown in FIG. 2, the scored end panels 50, 54 have two score lines which divide the rectangular panel into three triangular shaped regions, central being an isosceles triangle having as its base the score line between the body panel and the end panel.

The carton 12 is loaded onto an appropriately sized mandrel 16 through the open top end 26 of the carton, with the bottom end closure panels 50, 52, 54, 56 extending beyond a distal free end 20 of the mandrel. The mandrel is preferably affixed to a turret 18 which, as it rotates, moves the distal free end 20 of the mandrel 16 in a circular path through a series of equally spaced carton processing stations. As illustrated in FIG. 1, a standard mandrel assembly includes six equally spaced mandrels radially affixed to a rotating turret, although more or fewer mandrels may be employed.

Mandrel assemblies having six mandrels are particularly preferred, as there are generally five or six processing stations required for the carton bottom folding operation. These are the feeding station 14 which loads the open-ended, rectangular carton blanks 12 onto the mandrels 16, a heating station 28, a folding station 30, a sealing station 36 and an outfeed station for removing the sealed bottom cartons from the mandrels. A cooling station is optionally utilized between the sealing station and the outfeed station.

The folding station 30 includes a pair of oppositely disposed reciprocating break fingers 32 which contact and fold inwardly the scored first 50 and third 54 bottom end closure panels. As shown in FIG. 1, it is standard in the art to have the break fingers 32 oriented so that they push in the scored bottom end panels from the sides. This is because known break finger designs would interfere with the forward movement of the cartons, if the break fingers were oriented front and back, rather than on the sides, relative to carton movement. The present invention provides, for the first time, a folding station which can be readily adapted between these two orientations. This is accomplished by means of break fingers 58, 60 which reciprocate between two positions, a first position wherein the break fingers are outside of the circle described by the bottom end panels of the carton, so that unfolded cartons can index into and out of the folding station without interference from the break fingers, and a second position wherein the break fingers engage and urge inward the scored first and third bottom end panels, thus commencing the folding process.

Figure 5:
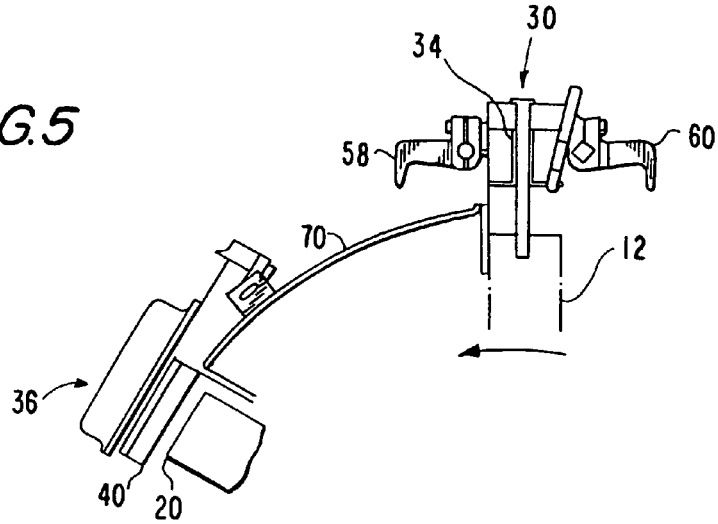
FIG. 5 is a partial view of the folding station and pressure sealing station of a preferred embodiment of the present invention.
Figure 3:
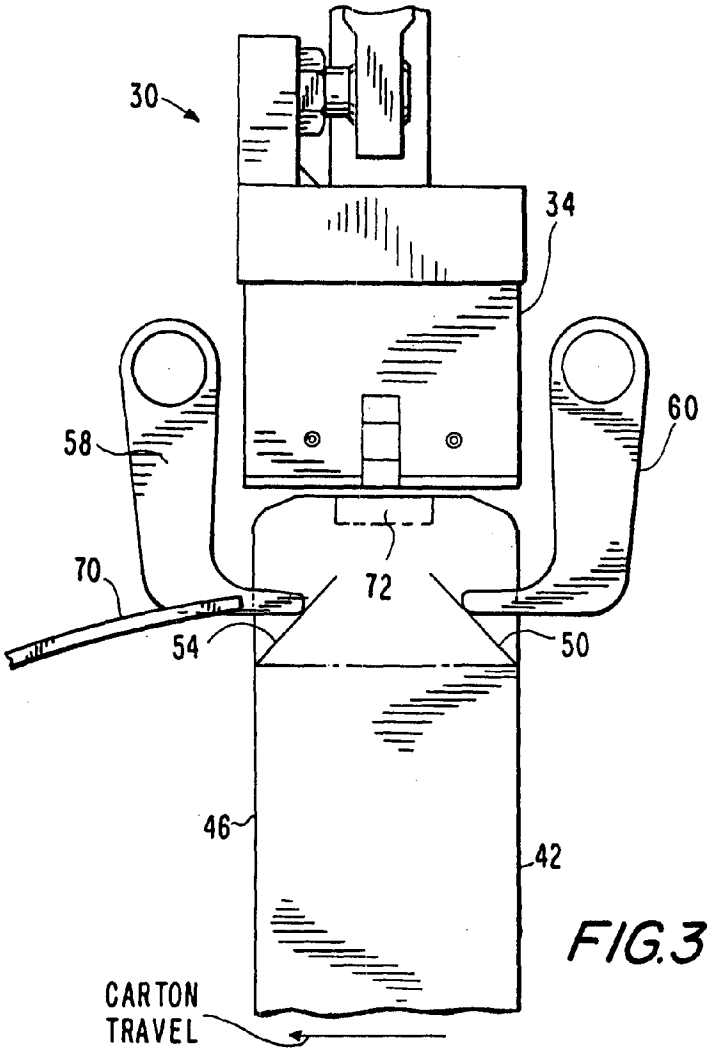
FIG. 3 is a side view, perpendicular to the direction of carton travel, of the folding station of a preferred embodiment of the apparatus of the present invention.

FIG. 3 illustrates a preferred embodiment of the folding station of the present invention wherein the break fingers 58, 60 are in the second, or "breaking" position. FIG. 5 shows the break fingers in the first position, allowing unimpeded movement of the mandrels and the cartons loaded thereon. It can be readily appreciated that the break fingers will assume the first position while the mandrel assembly rotates cartons from station to station, then will reciprocate down to the second position and back up to the first position while the mandrel assembly pauses briefly with the mandrels at their respective processing stations. A preferred break finger, as illustrated in FIG. 3 and FIG. 5, has a generally L-shaped configuration and is pivotable about one end thereof.

When the folding station of the present invention is oriented such that the break fingers are in the direction of carton movement, a forward break finger 58 breaks the first bottom end closure panel 50 and a rearward break finger 60 breaks the third bottom end closure panel 54. At this point in the folding process, the bottom end of the carton will have an appearance much like the carton illustrated in FIG. 2; the scored first 50 and third 54 bottom end panels are folded partially in, and this partial folding biases the second 52 and fourth 56 end panels partially inward.

Figure 4:
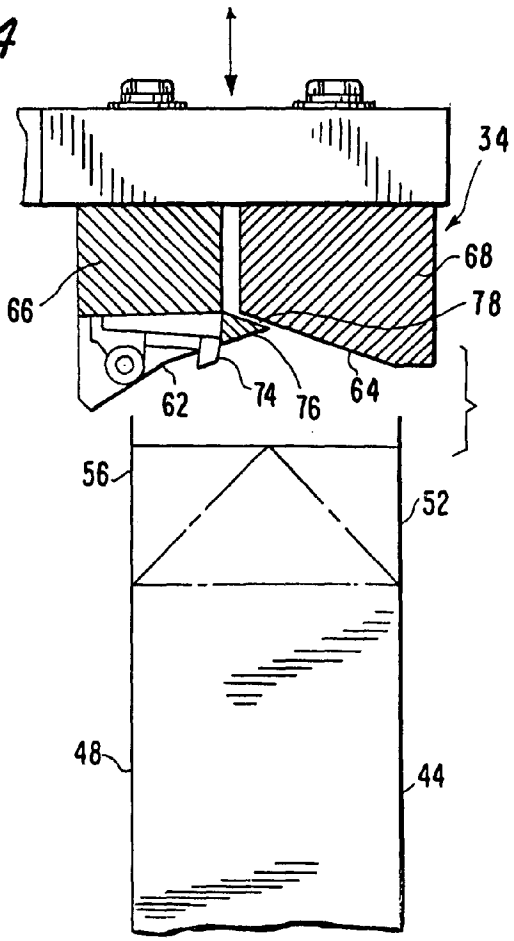
FIG. 4 is front view in partial cutaway, taken in the direction of carton travel, of the folding station of a preferred embodiment of the apparatus of the present invention.

The folding is substantially completed by a reciprocating hooder unit 34 which moves up and down along the longitudinal axis of the carton as it is aligned with the folding station 30. As illustrated in FIG. 4, the hooder unit 34 has first 62 and second 64 angled surfaces which contact and fold inwardly down the second 52 and fourth 56 bottom end closure panels as the hooder unit 34 is moved toward the mandrel 16 and the carton loaded thereon. In a preferred embodiment of the invention, the hooder unit 34 has first 66 and second 68 adjacent hooder elements each having a smooth bottom surface angled acutely upward and inward from an opposite peripheral edge. The first 66 and second 68 hooder elements can be generally rectangular in cross-section with adjacent sides. In a particularly preferred embodiment of the invention, the angled surface 62 of the first hooder element 66 includes an overhanging region 76 which extends over the angled surface 64 of the second hooder element 68 and provides a paper guide path 78 which ensures that the second angled surface 64 biases the second bottom end panel 52 over the fourth bottom end panel 56, so that the second bottom end panel 52 becomes the outermost bottom panel in the assembled carton.

The apparatus of the present invention can further include means for folding back a J-flap when cartons including J-flaps are assembled. A J-flap is a region at the end of an end panel which is folded back in order to prevent a raw paperboard edge from contacting the interior contents of the carton, and is commonly a rectangular region which is die cut at the sides and scored to fold back upon the panel from which it is formed. For example, a J-flap region 72 may be cut into the outer edge of the bottom end panel 56 as illustrated in FIG. 2 and FIG. 3 with side cut lines 72*a* and 72*b* and a score line 73. Referring to FIG. 4, a J-flap pull finger 74 resides within the interior of the first hooder element 66 and extends at an acute angle through the plane of the first angled surface 62 to catch and fold the J-flap region 72 about the score line 73 and back toward the outer surface of the fourth bottom end panel 56.

A preferred embodiment of the present invention includes a J-flap pull finger 74 which is recessed into one of the two angled surfaces of the hooder unit and which can be moved between two positions, exposed and recessed. FIG. 4 illustrates a hooder unit 34 wherein the J-flap pull finger 74 is in the exposed position, i.e., the pull finger 74 extends beyond the plane of the angled surface 62 so that, as the hooder unit 34 is moved downward toward the carton bottom, the edge of the fourth bottom end panel 51*i*, including the J-flap region 72 thereon, slides inwardly up along the angled surface 62. As the edge of the end panel 56 traverses the angled surface 62, the J-flap region 72 engages the exposed J-flap pull finger 74 and is folded backwards to form a folded J-flap. When cartons do not contain J-flap regions, the J-flap pull finger 74 is moved into a recessed position, wherein it resides completely within the hooder unit 34. Once the first and second hooder elements 66, 68 are at rest on top of the newly closed carton bottom, the mandrel 16 begins to index the carton to a ski plate 70 (described below.) The hooder elements 66, 68 stay in the rest position until the newly formed carton is moved from the hooder elements 66, 68 to the ski plate 70 after which the hooder elements move away from the mandrel 16.

The folded, unsealed carton bottom next is indexed to a pressure sealing station 36, where the folded bottom end panels are squeezed tightly between a sealing plate 40 and the end of the mandrel 20, thus forming the bottom end wall of the carton. The mandrel 16 optionally includes an end cap 22 removably affixed to the distal free end 20 of the mandrel. The use of removable end caps allows for processing of cartons of different sizes on standard machinery, for example, 1 quart/1 liter size cartons, ½ gallon/2 liter size cartons, and other sizes, both larger and smaller.

Accordingly, with the folding station in one orientation, the distal free end of the mandrel sequentially indexes through the heating station, the folding station and the pressure sealing station, with the scored first end panel facing forward relative to the direction of mandrel movement. In another orientation, the scored first end panel is on the side of the carton, relative to the direction of movement.

In the process of moving from the folding station 30 to the sealing station 36, the folded, but unsealed carton bottom must be maintained in a flat folded condition. As illustrated in FIG. 5, this is generally accomplished by means of an arcuate ski plate 70 extending between the folding station 30 and the sealing station 36. The ski plate 70 can be slightly upturned at the end abutting the folding station, so that the folded bottom end slides flat onto and along the ski plate, maintaining a flat shape as it moves between the two stations. It can be seen from FIG. 3 that the forward break finger 58 is perpendicular to and passes through the plane of the ski plate 70. The ski plate 70 preferably has a notch immediately adjacent the folding station 30 which is sized to permit passage therethrough of the reciprocating forward break finger 58. Otherwise, the ski plate has a generally rectangular profile.

The pressure sealing station 36 preferably includes a piston 38 which presses the folded bottom end panels between the sealing plate 40 and the mandrel end cap 22 in order to complete the sealing process. The apparatus can include a dedicated cooling station after the sealing station, but this is an optional station, as the sealed end wall will cool to ambient temperature if no cooling station is employed. The sealing station can also serve a dual function, by combining cooling means with the aforementioned sealing means at a single station.

Various modifications and variations may be devised given the above-described embodiments of the invention. It is intended that all embodiments and modifications and variations thereof be included within the scope of the invention as it is defined in the following claims. For example, while the J-flap pull finger 74 is illustrated in FIG. 4 as situated within the first hooder element, it could be just as appropriately situated within the second hooder element 68. Also, while the drawing figures illustrate an apparatus having six regularly spaced mandrels, more or fewer can be suitably employed.

What is claimed is:

1. An apparatus for forming a bottom end wall of a carton from a retangular carton blank having open top and bottom ends, first, second, third and fourth body panels adjoining first, second, third and fourth bottom end closure panels, respectively, with first and third bottom end closure panels oppositely disposed and scored to fold inwardly when the second and fourth bottom end closure panels are folded inwardly down to form the bottom of the carton, comprising:

a) a mandrel adapted to receive said carton blank through said open top end of said carton blank, with said bottom end closure panels extending beyond a distal free end of said mandrel, said distal free end indexable through a plurality of carton processing stations;

b) a heating station;

c) a folding station including:

i) a pair of oppositely disposed reciprocating break fingers to contact and fold inwardly said first and third bottom end closure panels;

ii) a reciprocating hooder unit having first and second angled surfaces and a direction of movement along a longitudinal axis of said mandrel at said folding station such that said angled surfaces contact and fold inwardly down said second and fourth bottom end closure panels as said hooder unit moves toward said mandrel; and iii) a J-flap pull finger recessed within said hooder unit and extending acutely past the plane of said first angled surface, said J-flap pull finger oriented to catch and fold a scored J-flap region of said second bottom end closure panel;

d) a pressure sealing station for sealing together said folded bottom end closure panels; and e) wherein said distal free end of said mandrel sequentially indexes through said heating station, said folding station and said pressure sealing station, with said first body panel facing forward relative to the direction of mandrel movement.

2. The apparatus as defined in claim 1, wherein a portion of said first angled surface extends over said second angled surface to form a paper guide path.

3. The apparatus as defined in claim 2, further comprising an arcuate ski plate between said folding station and a sealing station for maintaining said bottom end closure panels in a folded state as said mandrel indexes said carton from said folding station to said sealing station.

4. The apparatus as defined in claim 3, wherein said ski plate has a generally rectangular profile and a notch immediately adjacent said folding station sized to permit passage therethrough of said reciprocating forward break finger.

5. The apparatus as defined in claim 4, wherein said mandrel is affixed to a turret which rotates said distal free end of said mandrel in a circular path through said carton processing stations.

6. The apparatus as defined in claim 5, having affixed to said turret six equally spaced mandrels.

7. The apparatus as defined in claim 6, further comprising a mandrel end cap removable affixed to said distal free end of said mandrel.

8. The apparatus as defined in claim 7, further comprising a carton blank feeding station for loading rectangular carton blanks onto said mandrel, and wherein said distal free end of said mandrel sequentially passes through said feeding station, said heating station, said folding station and said pressure sealing station.

9. The apparatus as defined in claim 8, further comprising a cooling station, wherein said distal free end of said mandrel sequentially passes through said feeding station, said heating station, said folding station, said pressure sealing station and said cooling station.

10. The apparatus as defined in claim 9, wherein said pressure sealing station includes a piston and a sealing plate for pressing said folded bottom end closure panels between said sealing plate and said mandrel end cap.

11. The apparatus as defined in claim 10, wherein said break fingers are pivotable to describe an arc of about 90°.

12. The apparatus as defined in claim 1, wherein said break fingers are generally L-shaped and are pivotable about an end thereof.

* * * * *